US010967475B2

(12) United States Patent
Chen et al.

(10) Patent No.: US 10,967,475 B2
(45) Date of Patent: Apr. 6, 2021

(54) POLISHING METHOD FOR OPTICAL ELEMENTS

(71) Applicants: XI'AN JIAOTONG UNIVERSITY, Shaanxi (CN); RESEARCH INSTITUTE OF XI'AN JIAOTONG UNIVERSITY IN SUZHOU, Jiangsu (CN); Yaolong Chen, Shaanxi (CN); Chuan Zhang, Shaanxi (CN); Xiaoyan Chen, Shaanxi (CN); Jun Zha, Shaanxi (CN)

(72) Inventors: Yaolong Chen, Shaanxi (CN); Chuan Zhang, Shaanxi (CN); Xiaoyan Chen, Shaanxi (CN); Jun Zha, Shaanxi (CN)

(73) Assignee: XI'AN JIAOTONG UNIVERSITY et al., Shaanxi (CN)

( * ) Notice: Subject to any disclaimer, the term of this patent is extended or adjusted under 35 U.S.C. 154(b) by 168 days.

(21) Appl. No.: 16/261,582

(22) Filed: Jan. 30, 2019

(65) Prior Publication Data

US 2019/0152013 A1 May 23, 2019

Related U.S. Application Data

(62) Division of application No. 14/772,307, filed on Sep. 2, 2015, now abandoned.

(30) Foreign Application Priority Data

Mar. 19, 2013 (CN) ..... 201320123105.7
Mar. 19, 2013 (CN) ..... 201320123777.8
Mar. 19, 2013 (CN) ..... 201320124181.X

(51) Int. Cl.
*B24B 13/02* (2006.01)
*B24B 13/06* (2006.01)
(Continued)

(52) U.S. Cl.
CPC ..... *B24B 9/14* (2013.01); *B24B 9/146* (2013.01); *B24B 9/148* (2013.01); *B24B 13/005* (2013.01);
(Continued)

(58) Field of Classification Search
CPC ..... B24B 9/14; B24B 9/146; B24B 9/148; B24B 13/0006; B24B 13/0012;
(Continued)

(56) References Cited

U.S. PATENT DOCUMENTS 2,932,925 A * 4/1960 Dalton ..... B24B 13/0012 451/289
3,815,294 A * 6/1974 Martiros ..... B24B 13/0057 451/42
(Continued)

FOREIGN PATENT DOCUMENTS

EP 0997228 A1 * 5/2000 ..... B24B 13/06

*Primary Examiner* — Eileen P Morgan

(57) ABSTRACT

A polishing device for optical elements includes: a tool shank (1), and a polishing disc base; wherein the tool shank (1) is connected to the polishing disc base and is mounted on a tool shaft of a numerical-controlled processing device; wherein a polishing film (3) is stuck on the polishing disc base; the polishing disc base is a profiling polishing disc base (7), a cylinder polishing disc base (2), a profiling polishing disc base (12) or a spherical polishing disc base (8); wherein the tool shank (1) is independent and universal, thereby reducing the processing cost of the polishing device. A polishing method for optical elements is based on the shapes mentioned above of the polishing disc base, including steps of: fixing a polishing disc connecting rod (11); sticking a polishing film (3); trimming the polishing film (3); and polishing an unprocessed work piece (6).

9 Claims, 10 Drawing Sheets

(51) Int. Cl.

| | |
|---|---|
| ***B24B 13/005*** | (2006.01) |
| ***B24B 9/14*** | (2006.01) |
| ***B24B 13/00*** | (2006.01) |
| ***B24B 13/01*** | (2006.01) |

(52) U.S. Cl.
CPC ..... *B24B 13/0006* (2013.01); *B24B 13/0012* (2013.01); *B24B 13/0018* (2013.01); *B24B 13/012* (2013.01); *B24B 13/02* (2013.01); *B24B 13/026* (2013.01); *B24B 13/06* (2013.01)

(58) Field of Classification Search
CPC ... B24B 13/0018; B24B 13/01; B24B 13/012; B24B 13/02; B24B 13/026; B24B 13/06; B24B 13/005
USPC ..... 451/5, 42, 242, 246, 256
See application file for complete search history.

(56) References Cited

U.S. PATENT DOCUMENTS

| | | | | |
|---|---|---|---|---|
| 4,580,882 | A * | 4/1986 | Nuchman | G02B 5/1876 351/159.41 |
| 6,712,675 | B1 * | 3/2004 | Giurgiuman | B24B 3/346 451/48 |
| 2002/0164930 | A1 * | 11/2002 | Hakomori | B24B 37/042 451/44 |
| 2004/0043710 | A1 * | 3/2004 | Miyazawa | B24D 13/147 451/42 |
| 2006/0099889 | A1 * | 5/2006 | Tabata | B24B 13/02 451/41 |
| 2012/0013846 | A1 * | 1/2012 | Dursteler Lopez | B24B 9/14 351/159.76 |
| 2017/0080542 | A1 * | 3/2017 | Horikoshi | B24D 11/04 |
| 2017/0274491 | A1 * | 9/2017 | Mukaiyama | B24B 13/02 |

* cited by examiner

POLISHING METHOD FOR OPTICAL ELEMENTS

CROSS REFERENCE OF RELATED APPLICATION

This is a Divisional application of the U.S. application Ser. No. 14/772,307, filed Sep. 2, 2015, which claims priority under 35 U.S.C. 119(a-d) to CN 201320123777.8, filed Mar. 19, 2013; CN 201320124181.X, filed Mar. 19, 2013; and CN 201320123105.7, filed Mar. 19, 2013.

BACKGROUND OF THE PRESENT INVENTION

Field of Invention

The present invention relates to optical element processing, and more particularly to a polishing device for optical elements and a method thereof.

Description of Related Arts

Conventional polishing techniques for spherical and planar optical elements are mainly high-speed polishing based on a quasi sphere center method. Devices thereof are cheap and operations are simple. However, according to the device, control of a contact pressure between a polishing disc and a work piece is inaccurate with a large floating range. Therefore, it is difficult to provide certain parameter processing. Moreover, according to conventional polishing methods, work pieces with same curvature radius and same caliber require only one polishing disc base, but work pieces with different curvature radius or different calibers require different polishing disc bases, which increases a processing cost.

Aspheric optical element has a great advantage with respect to the spherical optical element. In different areas of modern society, aspheric optical elements are greatly demanded. Therefore, how to accurately and efficiently process the aspheric optical elements has become an urgent problem to be solved.

Conventionally, mature numerical-controlled polishing technology for aspheric optical elements is mainly applied to processing of optical elements with large calibers, comprising: numerical-controlled optical surface forming technology based on small polishing disc, stress plate polishing technology, ion beam polishing technology, and magneto-rheological technology. Surface accuracy of the numerical-controlled processing technologies described above is very high, and is better than $\lambda/10$. However, processing costs thereof are unacceptable for the aspheric optical elements which are more and more widely applied. Processing of aspheric optical elements with large calibers has basically gotten rid of manual methods.

For aspheric optical elements with medium or small calibers, manual processing and numerical-controlled processing are both conventionally used. Manual processing has a high requirement for worker experience. Surface accuracy of optical elements processed by experienced works with high accuracy is also up to $\lambda/10$, but efficiency is low and demands for aspheric optical elements are not satisfied. The numerical-controlled processing technology for aspheric optical elements with medium or small calibers are mainly compression molding, injection molding, etc., whose efficiency is very high. However, because of a processing principle of copy processing, accuracy is largely limited by moulds, and materials to be processed are also limited.

SUMMARY OF THE PRESENT INVENTION

An object of the present invention is to provide a polishing device for optical elements and a method thereof, for increasing processing accuracy and efficiency, and lowering manufacturing costs.

A core of the present invention is a polishing method, wherein during polishing, a polishing film of the polishing tool is trimmed to form a spherical surface, a ring-like surface, a cylindrical surface, a conical surface or a plane. Contact between the polishing film and a work piece is a theoretical point-contact, line-contact or partial surface contact (the polishing film contacts not the whole work piece surface) according to a shape of a surface to be polished. A polishing pressure between the polishing tool and the work piece depends on an elastic modulus of the polishing film. Shapes of the work piece and the polishing tool, a pressing depth of the polishing tool (similar to a cutting depth when grinding), and a polishing pressure value are controlled according to a moving trace of the polishing tool relative to the work piece. The moving trace of the polishing tool relative to the work piece equals to the one during grinding. By trace control, it is ensured that the pressing depth of the polishing tool is corresponding to a required polishing pressure. A material removal mechanism is same as the one of conventional polishing methods, which depends on the polishing pressure, a relative linear speed, characteristics of the polishing film and the work piece, and a characteristic of polishing liquid.

The present invention firstly provides:

a partial surface-contacted polishing device for spherical and planar optical elements, comprising: a tool shank, and a cylinder polishing disc base; wherein the tool shank is connected to the cylinder polishing disc base and is mounted on a tool shaft of a numerical-controlled processing device, or the cylinder polishing disc base is integrated with the tool shaft for being a individual polishing device; wherein a polishing film is stuck on the cylinder polishing disc base.

Preferably, a polishing disc connecting rod is extruded from a bottom of the tool shank, for cooperating with a polishing disc fixing port hollowed at a top of the cylinder polishing disc base, wherein when the tool shank and the cylinder polishing disc base are connected and fixed, the polishing disc connecting rod is pressed into the polishing disc fixing port without interval for ensuring a coaxiality of the cylinder polishing disc base and the tool shaft.

Preferably, threaded fittings are provided on both the tool shank and the cylinder polishing disc base, the tool shank and the cylinder polishing disc base are fixed by screws. Preferably, the bolt is an inner hexagon bolt, which not only ensures connecting reliability therebetween, but also is convenient to install and maintain.

Preferably, the cylinder polishing disc base is cylinder-shaped, and a bottom thereof is arc-shaped; the cylinder polishing disc base comprises the polishing disc fixing port hollowed at the top thereof; the polishing film is stuck on an arc portion at the bottom of the cylinder polishing disc base. The polishing film is selected according to a material of the unprocessed work piece. There is no requirement for a shape of the polishing film as long as sticking is convenient and fixed.

Preferably, a curvature radius of the bottom, which is arc-shaped, of the cylinder polishing disc base is $r_1$; before utilization, the polishing film stuck on the arc portion of the cylinder polishing disc base is trimmed, in such a manner that a surface section curve thereof is a precise arc with a curvature radius of $r_2$; a height of the polishing film is h, which satisfies $r_2=r_1+h$.

A partial surface-contacted polishing method for spherical and planar optical elements, comprises steps of:

1) pressing a polishing disc connecting rod into a polishing disc fixing port, and fixing with screws, in such a manner that no interval exists therebetween;

2) sticking a polishing film on an arc-portion at a bottom of a cylinder polishing disc base with a binding agent, and trimming a curvature radius of the polishing film after the binding agent is solidified;

3) during trimming, installing a polishing device on a work piece shaft of a numerical-controlled device, and installing a trimming grinding wheel on a tool shaft of the numerical-controlled device; trimming the curvature radius of the polishing film by point-contacting, in such a manner that the curvature radius of the polishing film is identical, and is same with a curvature radius of the spherical or the planar optical element in value and opposite in direction; and 4) during utilization, installing the polishing device on the tool shaft of the numerical-controlled device, and installing an unprocessed work piece on the work piece shaft of the numerical-controlled device; during polishing, firstly inputting surface forming parameters of the unprocessed work piece and size parameters of the polishing device into a processing software, and generating a numerical-controlling file, so as to precisely position the polishing device and the unprocessed work piece by the numerical-controlled device, in such a manner that a curvature center of the polishing film coincides with a curvature center of the unprocessed work piece at any processing position; a surface of the polishing device forms ring-surface-contact with a surface of the unprocessed work piece for polishing.

Preferably, during utilization, the polishing device is installed on the tool shaft of the numerical-controlled device; the polishing device rotates around an axis of the tool shaft and swings around a swinging center B of the tool shaft; the polishing device is also movable along a horizontal direction; the unprocessed work piece is installed on the work piece shaft of the numerical-controlled device; the unprocessed work piece rotates around an axis of the work piece shaft and is movable along a vertical direction; a moving speed of the cylinder polishing disc base and a rotation speed of the unprocessed work piece are controlled by the numerical-controlled device at each processing position, in such a manner that a contacting pressure therebetween is constant at any processing position, for keeping a constant removal amount, and further achieving certain parameter processing.

Preferably, a trimming tool is a grinding wheel with an uncertain-shaped cutting blade, or a facing cutter with a certain-shaped cutting blade.

Preferably, a curvature radius of the bottom, which is arc-shaped, of the cylinder polishing disc base is $r_1$; before utilization, the polishing film stuck on the arc portion of the cylinder polishing disc base is trimmed, in such a manner that a surface section curve thereof is a precise arc with a curvature radius of $r_2$; a height of the polishing film is h, which satisfies $r_2=r_1+h$.

The present invention secondly provides:

a line-contacted polishing device for spherical and planar optical elements, comprising: a tool shank, and a polishing disc base; wherein the tool shank is connected to the polishing disc base and is mounted on a tool shaft of a numerical-controlled processing device, or the polishing disc base is integrated with the tool shaft for being a individual polishing device; wherein a polishing film is stuck on the polishing disc base; the polishing disc base is a profiling polishing disc base or a cylinder polishing disc base.

Preferably, a polishing disc connecting rod is extruded from a bottom of the tool shank, for cooperating with a polishing disc fixing port hollowed at a top of the polishing disc base, wherein when the tool shank and the polishing disc base are connected and fixed, the polishing disc connecting rod is pressed into the polishing disc fixing port without interval for ensuring a coaxiality of the cylinder polishing disc base and the tool shaft.

Preferably, threaded fittings are provided on both the tool shank and the polishing disc base, the tool shank and the polishing disc base are fixed by screws. Preferably, the bolt is an inner hexagon bolt, which not only ensures connecting reliability therebetween, but also is convenient to install and maintain.

Preferably, the profiling polishing disc base is a solid of revolution, a generating curve thereof is an arc with a curvature radius of $r_1$; the polishing disc fixing port is provided at an end of the profiling polishing disc base for installing the profiling polishing disc base on the tool shank; before utilization, the polishing film is stuck on a revolution surface of the profiling polishing disc base, and a generating curve of the polishing film is precisely trimmed for being an arc with an curvature radius of $r_2$; a height of the polishing film is h, which satisfies $r_2=r_1+h$.

Preferably, the polishing disc base is a cylinder, a first end thereof is arc-shaped with a curvature radius of $r_3$, and the polishing disc fixing port is provided at a second end thereof for installing the cylinder polishing disc base on the tool shank; before utilization, the polishing film is stuck on an arc portion at a bottom of the cylinder polishing disc base; and a section curve of the polishing film is precisely trimmed for being an accurate arc with an curvature radius of $r_4$; the height of the polishing film is h, which satisfies $r_4=r_3+h$.

A line-contacted polishing method for spherical and planar optical elements, comprises steps of:

1) pressing a polishing disc connecting rod into a polishing disc fixing port, and fixing with screws, in such a manner that no interval exists therebetween;

2) sticking a polishing film on a bottom of a polishing disc base with a binding agent, and trimming a curvature radius of the polishing film after the binding agent is solidified;

3) during trimming, installing a polishing device on a work piece shaft of a numerical-controlled device, and installing a trimming grinding wheel on a tool shaft of the numerical-controlled device; trimming the curvature radius of the polishing film by point-contacting, in such a manner that the curvature radius of the polishing film is identical; and 4) during utilization, installing the polishing device on the tool shaft of the numerical-controlled device, and installing an unprocessed work piece on the work piece shaft of the numerical-controlled device; during polishing, firstly inputting surface forming parameters of an aspheric surface of the unprocessed work piece and size parameters of the polishing device into a processing software, and generating a numerical-controlling file, so as to control the polishing device and the unprocessed work piece by the numerical-controlled device, in such a manner that the polishing device line-contacts with the unprocessed work piece at any processing position; wherein during polishing, a contacting trace of a profiling polishing disc base and the unprocessed work piece is a portion of a meridian section curve of the unprocessed work piece, which belongs to profiling processing; a contacting trace of a cylinder polishing disc base and the unprocessed work piece is an envelope circle, which belongs to generating processing.

Preferably, during utilization, the polishing device is installed on the tool shaft of the numerical-controlled device; the polishing device rotates around an axis of the tool shaft and swings around a swinging center B of the tool shaft; the polishing device is also movable along a horizontal direction; the unprocessed work piece is installed on the work piece shaft of the numerical-controlled device; the unprocessed work piece rotates around an axis of the work piece shaft and is movable along a vertical direction; a moving speed of the cylinder polishing disc base and a rotation speed of the unprocessed work piece are controlled by the numerical-controlled device at each processing position, in such a manner that a contacting pressure therebetween is constant at any processing position, for keeping a constant removal amount, and further achieving certain parameter processing.

Preferably, a trimming tool is a grinding wheel with an uncertain-shaped cutting blade, or a facing cutter with a certain-shaped cutting blade.

Preferably, the polishing film is stuck on a revolution surface of the profiling polishing disc base, and a sticking height ensures that the polishing film is fixedly stuck and covers the whole revolution surface; or the polishing film is stuck on a bottom, which is arc-shaped, of the cylinder polishing disc base. There is no requirement for a shape of the polishing film as long as sticking is convenient and fixed.

Preferably, the profiling polishing disc base is a solid of revolution, a generating curve thereof is an arc with a curvature radius of $r_1$; a generating curve of the polishing film after being precisely trimmed is an arc with an curvature radius of $r_2$; and a height of the polishing film is h, which satisfies $r_2=r_1+h$; or the polishing disc base is a cylinder, a first end thereof is arc-shaped with a curvature radius of $r_3$, a section curve of the polishing film after being precisely trimmed is an accurate arc with an curvature radius of $r_4$; and the height of the polishing film is h, which satisfies $r_4=r_3+h$.

The present invention thirdly provides:

a point-contacted polishing device for aspheric optical elements, comprising: a tool shank, and a polishing disc base; wherein the tool shank is connected to the polishing disc base and is mounted on a tool shaft of a numerical-controlled processing device, or the polishing disc base is integrated with the tool shaft for being a individual polishing device; wherein a polishing film is stuck on the polishing disc base; the polishing disc base is a bowl-like polishing disc base or a spherical polishing disc base.

Preferably, a polishing disc connecting rod is extruded from a bottom of the tool shank, for cooperating with a polishing disc fixing port hollowed at a top of the polishing disc base, wherein when the tool shank and the polishing disc base are connected and fixed, the polishing disc connecting rod is pressed into the polishing disc fixing port without interval for ensuring a coaxiality of the cylinder polishing disc base and the tool shaft.

Preferably, threaded fittings are provided on both the tool shank and the polishing disc base, the tool shank and the polishing disc base are fixed by screws. Preferably, the bolt is an inner hexagon bolt, which not only ensures connecting reliability therebetween, but also is convenient to install and maintain.

Preferably, the polishing disc base is the bowl-like polishing disc base which is cylinder-shaped, and a bottom thereof is arc-shaped; the bowl-like polishing disc base comprises the polishing disc fixing port hollowed at the top thereof; the polishing film is stuck on an arc portion at the bottom of the bowl-like polishing disc base; wherein a curvature radius of the bottom of the bowl-like polishing disc base is $r_1$; a surface section curve of the polishing film after being trimmed is a precise arc with a curvature radius of $r_2$; a height of the polishing film is h, which satisfies $r_2=r_1+h$.

Preferably, the polishing disc base is the spherical polishing disc base which is spherical-shaped or partly spherical-shaped; the spherical polishing disc base comprises the polishing disc fixing port hollowed at the top thereof; the polishing film is stuck on a spherical surface; wherein a curvature radius of spherical polishing disc base is $r_3$; a curvature radius of the polishing film after being trimmed is $r_4$; and a height of the polishing film is h, which satisfies $r_4=r_3+h$.

A point-contacted polishing method for aspheric optical elements, comprises steps of:

1) pressing a polishing disc connecting rod into a polishing disc fixing port, and fixing with screws, in such a manner that no interval exists therebetween;

2) sticking a polishing film on a polishing disc base with a binding agent, and trimming a curvature radius of the polishing film after the binding agent is solidified;

3) during trimming, installing a polishing device on a work piece shaft of a numerical-controlled device, and installing a trimming grinding wheel on a tool shaft of the numerical-controlled device; trimming the curvature radius of the polishing film by point-contacting, in such a manner that the curvature radius of the polishing film is identical; and 4) during utilization, installing the polishing device on the tool shaft of the numerical-controlled device, and installing an unprocessed work piece on the work piece shaft of the numerical-controlled device; during polishing, firstly inputting surface forming parameters of an aspheric surface of the unprocessed work piece and size parameters of the polishing device into a processing software, and generating a numerical-controlling file, so as to control the polishing device and the unprocessed work piece by the numerical-controlled device, in such a manner that the polishing device contacts with the unprocessed work piece at a P point of any processing position; wherein the P point coincides with an aspheric meridian section curve relative to a moving trace of the unprocessed work piece.

Preferably, if the unprocessed work piece is convex and is to be externally polished, trimming an external arc of the polishing film; if the unprocessed work piece is convex and is to be internally polished, trimming an internal arc of the polishing film; i3 the unprocessed work piece is concave, trimming the external arc of the polishing film, or trimming the external arc and the internal arc of the polishing film. A trimming tool is a grinding wheel with an uncertain-shaped cutting blade, or a facing cutter with a certain-shaped cutting blade. There is no requirement for a shape of the polishing film as long as sticking is convenient and fixed.

Preferably, during utilization, the polishing device is installed on the tool shaft of the numerical-controlled device; the polishing device rotates around an axis of the tool shaft and swings around a swinging center B of the tool shaft; the polishing device is also movable along a horizontal direction; the unprocessed work piece is installed on the work piece shaft of the numerical-controlled device; the unprocessed work piece rotates around an axis of the work piece shaft and is movable along a vertical direction; a moving speed of the cylinder polishing disc base and a rotation speed of the unprocessed work piece are controlled by the numerical-controlled device at each processing position, in such a manner that a contacting pressure therebetween is constant at any processing position, for keeping a constant removal amount, and further achieving certain parameter processing.

Preferably, a curvature radius of the bottom of the bowl-like polishing disc base is $r_1$; a surface section curve of the polishing film after being trimmed is a precise arc with a curvature radius of $r_2$: a height of the polishing film is h, which satisfies $r_2=r_1+h$; wherein a curvature radius of spherical polishing disc base is $r_3$; a curvature radius of the polishing film after being trimmed is $r_4$; and a height of the polishing film is h, which satisfies $r_4=r_3+h$.

The present invention has advantages as follows.

1) According to the present invention, the curvature radius of the polishing film is able to be accurately trimmed.

2) According to the present invention, the tool shank is independent and universal, thereby reducing the processing cost of the polishing device.

3) According to the conventional spherical and planar optical elements polishing techniques, an entire surface of a polishing disc contacts with a work piece, which is spherical or planar contact, and depends on swinging of the polishing disc to achieve disorder polishing. According to the present invention, the polishing disc is cylinder-shaped. During polishing, ring-surface-contact is formed. By trimming the polishing film, polishing discs with same sizes are applicable to work pieces with different curvature radii.

4) According to the conventional polishing techniques, a quasi sphere center method is utilized. A polishing disc is surface-contacted with a work piece and polishes with a profiling method. According to the present invention, the polishing disc is line-contacted with the work piece, which means that during polishing, a contacting trace of the polishing disc and the work piece is a closed or a non-close curve. Because of rotation of the work piece, a desired surface is obtained.

5) According to the present invention, the polishing discs, especially the bowl-like polishing disc, are universal. By trimming the polishing film, polishing discs with same sizes are applicable to work pieces with different curvature radii.

6) According to the present invention, the moving speed of the polishing disc base and the rotation speed of the unprocessed work piece are controlled by the numerical-controlled device at each processing position, in such a manner that the contacting pressure therebetween is constant at any processing position, for keeping a constant removal amount, and further achieving certain parameter processing.

Figure 1:
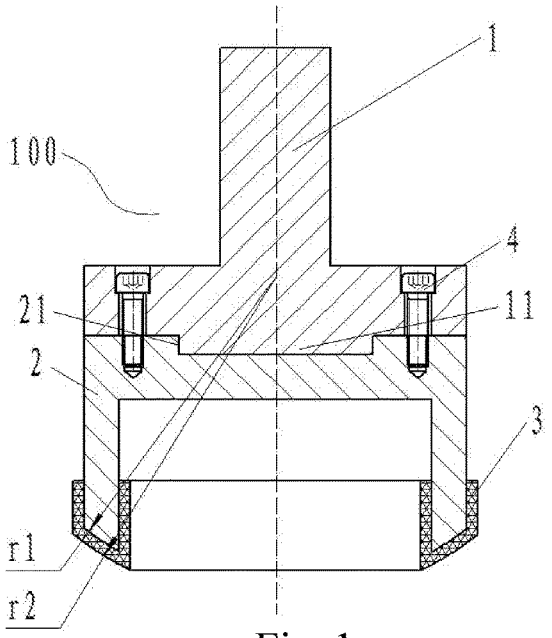
FIG. 1 is a sketch view of a polishing device according to a preferred embodiment 1 of an embodiment 1 of the present invention.

Element reference: 1—tool shank: 2—cylinder polishing disc base; 3—polishing film; 4—screw; 5—trimming grinding wheel; 6—unprocessed work piece; 7—profiling polishing disc base; 8—spherical polishing disc base; 9—work piece; 11—polishing disc connecting rod; 12—bowl-like polishing disc base; 21—polishing disc fixing port; 31—external arc; 32—internal arc; 100—polishing device.

DETAILED DESCRIPTION OF THE PREFERRED EMBODIMENT

Referring to preferred embodiments, the present invention is further illustrated.

Referring to FIGS. 1-11, an embodiment 1 of the present invention is illustrated.

Accordingly, the embodiment 1 provides a surface-contacted polishing device for spherical and planar optical elements.

Preferred Embodiment 1

Referring to FIGS. 1-5, a polishing disc connecting rod 11 is at a bottom of a tool shank 1, which is able to be pressed into a polishing disc fixing port 21 at a top of a cylinder polishing disc base 2. During installing, the polishing disc connecting rod 11 is pressed into the polishing disc fixing port 21, and is fixed with the cylinder polishing disc base 2, in such a manner that there is no interval between the polishing disc connecting rod 11 and the polishing disc fixing port 21; wherein the tool shank 1 is fixed on the cylinder polishing disc base 2 by any spanner type, such as inner triangle, inner rectangle, inner hexagon, and double hole, which not only ensures connecting reliability therebetween, but also is convenient to install and maintain.

A polishing film 3 is stuck on an arc portion at a bottom of the cylinder polishing disc base 2. The polishing film 3 is selected according to a material of the unprocessed work piece 6. There is no requirement for a shape of the polishing film 3 as long as sticking is convenient and fixed. The polishing film 3 is stuck on the arc portion at the bottom of the cylinder polishing disc base 2 by a binding agent, and a sticking height ensures that the polishing film 3 is fixedly stuck.

During installing, the polishing disc connecting rod 11 is pressed into the polishing disc fixing port 21. Preferably, screws 4, which are inner hexagon bolts, are used for fixing, in such a manner that no interval exists therebetween. One side of the polishing film 3 is applied with the binding agent for being stuck on the arc-portion at the bottom of the cylinder polishing disc base 2. Preparation is finished after the binding agent is solidified.

After installing as above, the polishing film 3 of the polishing device 100 is trimmed. The polishing device 100 is installed on a work piece shaft of a numerical-controlled device, and a trimming grinding wheel 5 is installed on a tool shaft of the numerical-controlled device. A curvature radius of the polishing film 3 is trimmed by point-contacting, in such a manner that the curvature radius of the polishing film 3 is identical, and is same with a curvature radius of the spherical or the planar optical element in value and opposite in direction for improving positioning accuracy and processing accuracy.

Figure 5:
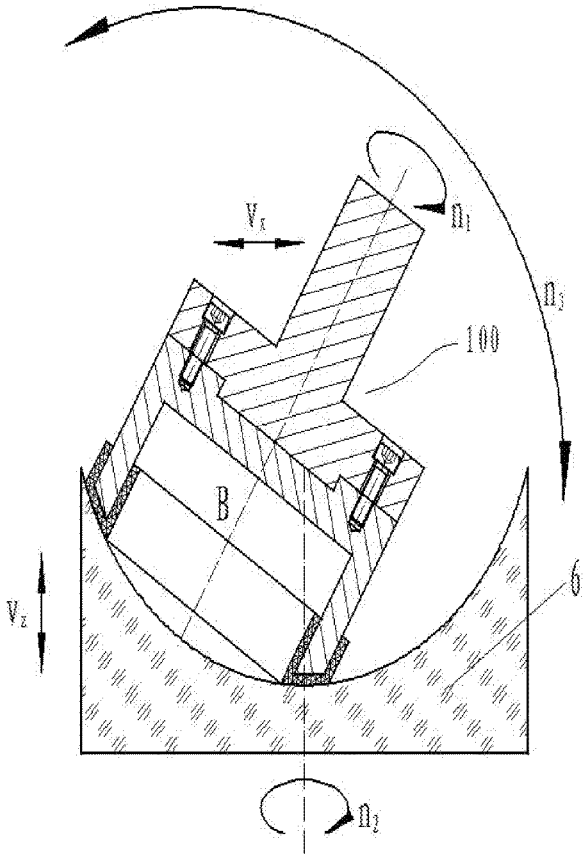
FIG. 5 illustrates polishing a concave element according to the preferred embodiment 1 of the embodiment 1.

FIG. 5 illustrates polishing a concave element according to the preferred embodiment 1. During utilization, the polishing device 100 is installed on the tool shaft of the numerical-controlled device. The polishing device 100 rotates around an axis of the tool shaft and swings around a swinging center B of the tool shaft; and the polishing device 100 is also movable along a horizontal direction. An unprocessed work piece 6 is installed on the work piece shaft of the numerical-controlled device. The unprocessed work piece 6 rotates around an axis of the work piece shaft and is movable along a vertical direction. During polishing, surface forming parameters of the unprocessed work piece 6 and size parameters of the polishing device 100 are firstly inputted into a processing software, for generating a numerical-controlling file, so as to precisely position the polishing device 100 and the unprocessed work piece 6 by the numerical-controlled device, in such a manner that the polishing device 100 coincides with the unprocessed work piece 6 at any processing position for polishing.

Preferred Embodiment 2

Figure 2:
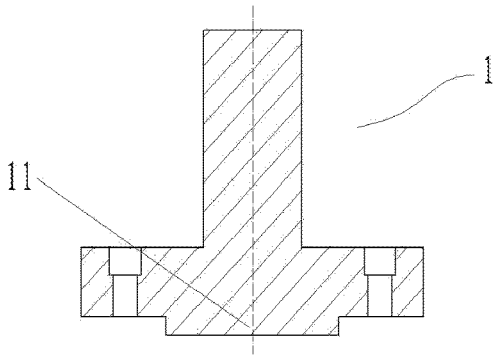
FIG. 2 is a sketch view of a tool shank of the present invention.
Figure 3:
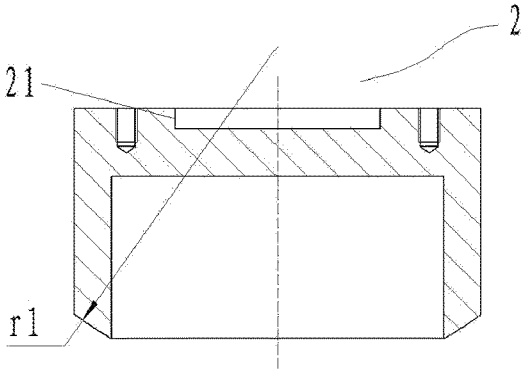
FIG. 3 is a sketch view of a cylinder polishing disc base in FIG. 1.
Figure 4:
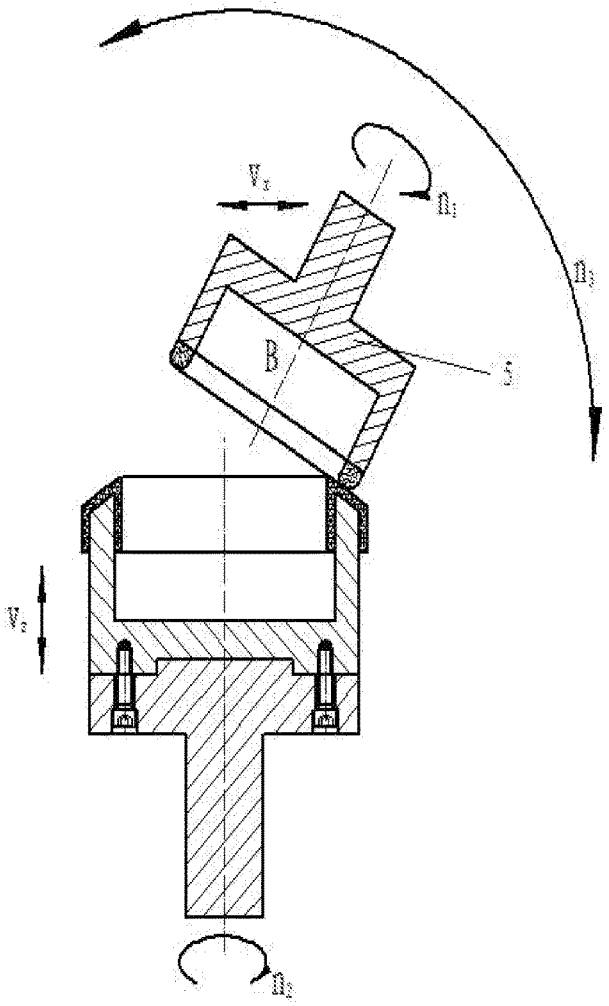
FIG. 4 illustrates trimming a polishing film according to the preferred embodiment 1 of the embodiment 1.
Figure 6:
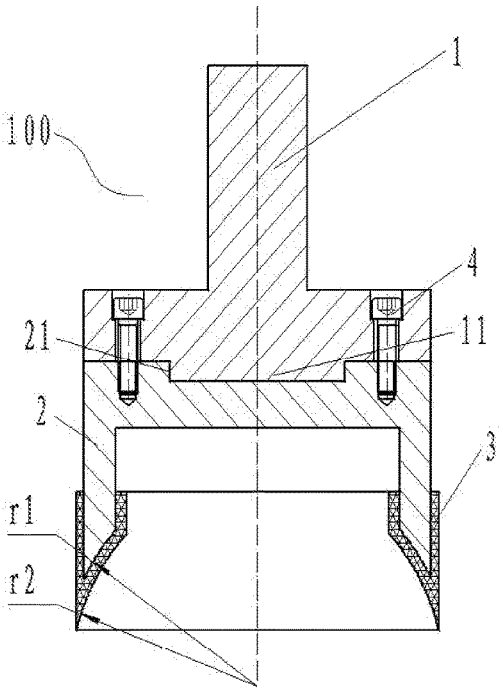
FIG. 6 is a sketch view of a polishing device according to a preferred embodiment 2 of the embodiment 1 of the present invention.
Figure 7:
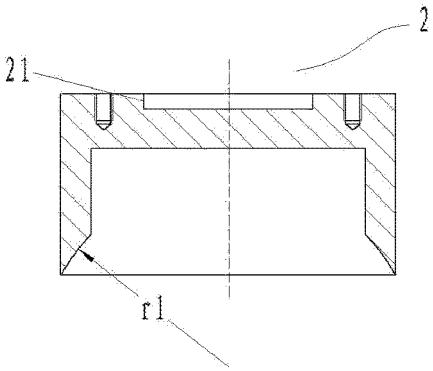
FIG. 7 is a sketch view of a cylinder polishing disc base in FIG. 6.

FIG. 6 is a sketch view of a polishing device 100 according to the preferred embodiment 2, wherein a tool shank 1 and a cylinder polishing disc base 2 are respectively illustrated in FIGS. 2 and 7. Accordingly, the polishing device 100 comprises: a tool shank 1 for installing a cylinder polishing disc; a cylinder polishing disc base 2 for sticking a polishing film 3; and the polishing film 3 for contacting with an unprocessed work piece 6 (not shown) for polishing. The preferred embodiment 2 is suitable for polishing convex elements, and installation and trimming of the polishing film 3 are the same with the preferred embodiment 1 and will not be described again.

Figure 8:
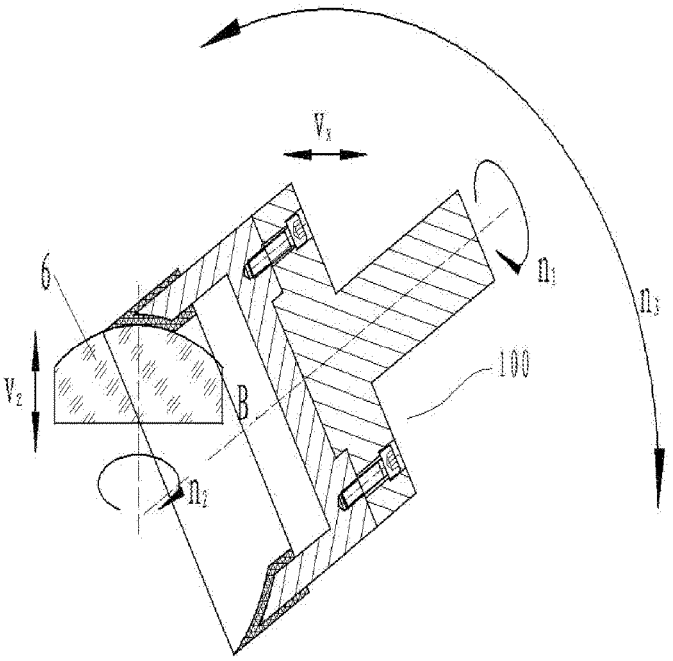
FIG. 8 illustrates polishing a convex element according to the preferred embodiment 2 of the embodiment 1.

FIG. 8 illustrates polishing the convex element according to the preferred embodiment 2, and a utilization method thereof is the same as the one of the preferred embodiment 1 and will not be described again.

Preferred Embodiment 3

Figure 9:
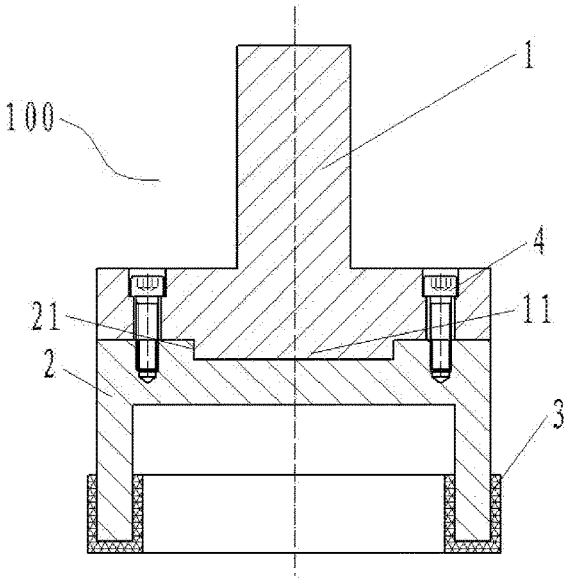
FIG. 9 is a sketch view of a polishing device according to a preferred embodiment 3 of the embodiment 1 of the present invention.
Figure 10:
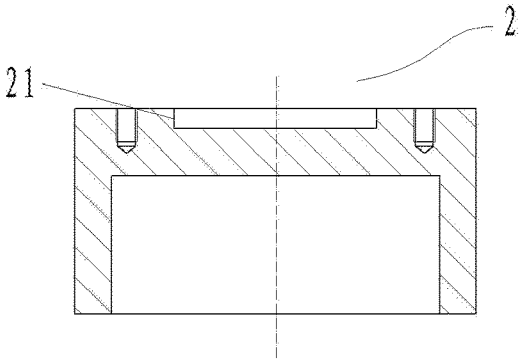
FIG. 10 is a sketch view of a cylinder polishing disc base in FIG. 9.

FIG. 9 is a sketch view of a polishing device 100 according to the preferred embodiment 3, wherein a tool shank 1 and a cylinder polishing disc base 2 are respectively illustrated in FIGS. 2 and 10. Accordingly, the polishing device 100 comprises: a tool shank 1 for installing a cylinder polishing disc; a cylinder polishing disc base 2 for sticking a polishing film 3; and the polishing film 3 for contacting with an unprocessed work piece 6 (not shown) for polishing. The preferred embodiment 2 is suitable for polishing planar elements, and installation and trimming of the polishing film 3 are the same with the preferred embodiment 1 and will not be described again. The preferred embodiment 3 is a specific type of the preferred embodiment 1 and 2, which is a special case when curvature radius of the arc portion of the polishing disc base in the preferred embodiment 1 or 2 tends to be infinity.

Figure 11:
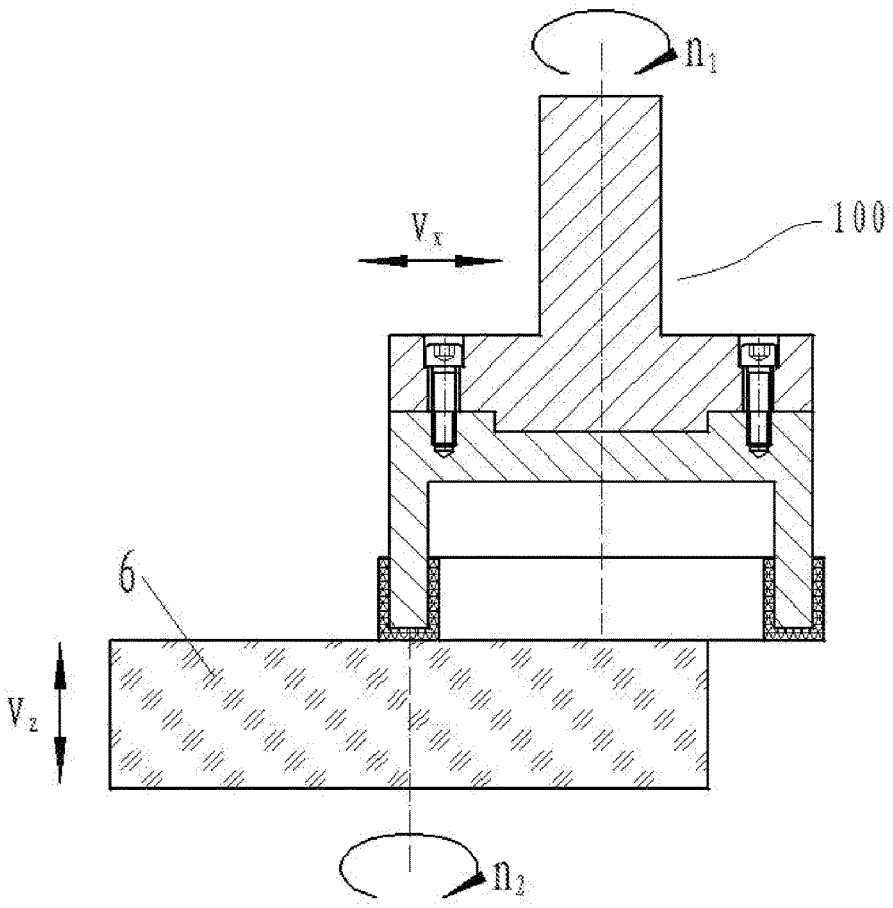
FIG. 11 illustrates polishing a planar element according to the preferred embodiment 3 of the embodiment 1.

FIG. 11 illustrates polishing the convex element according to the preferred embodiment 3, and a utilization method thereof is the same as the one of the preferred embodiment 1 and will not be described again.

It should be understand that, no matter in the preferred embodiment 1, 2 or 3, a contacting area between the polishing film 3 and the unprocessed work piece 6 is relatively small. Therefore, the polishing film 3 is easy to be worn out, but the polishing device 100 has certain universality, which means that by precisely trimming the curvature radius of the polishing film 3, the polishing device 100 is suitable for polishing elements with different calibers and curvature radius.

An Embodiment 2 of the Present Invention

A line-contacted polishing device for spherical and planar optical elements is provided.

Preferred Embodiment 4

Figure 12:
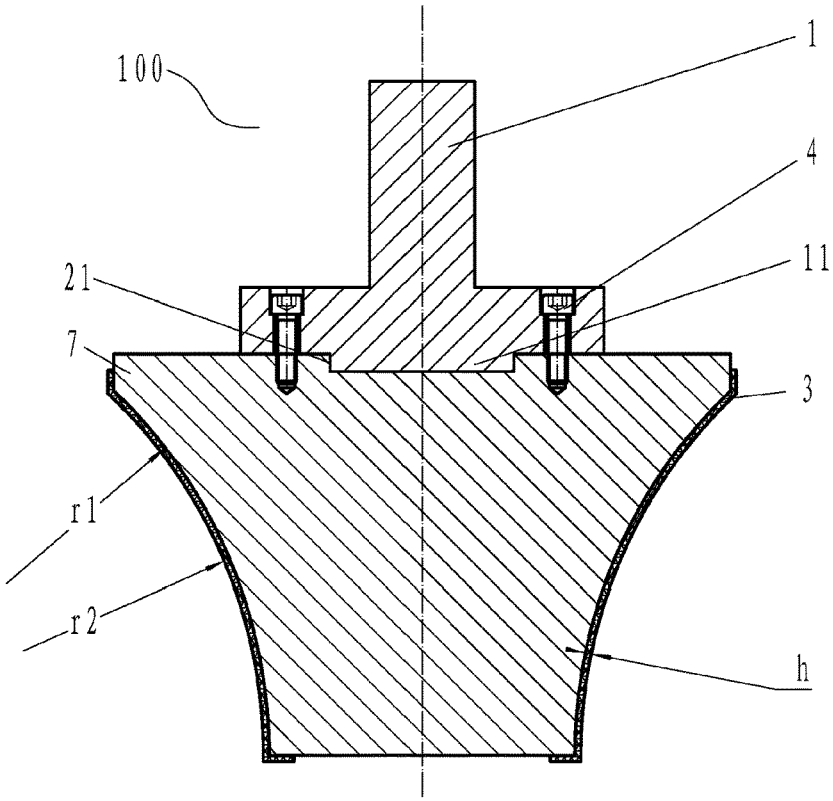
FIG. 12 is a sketch view of a polishing device according to a preferred embodiment 4 of an embodiment 2 of the present invention.
Figure 13:
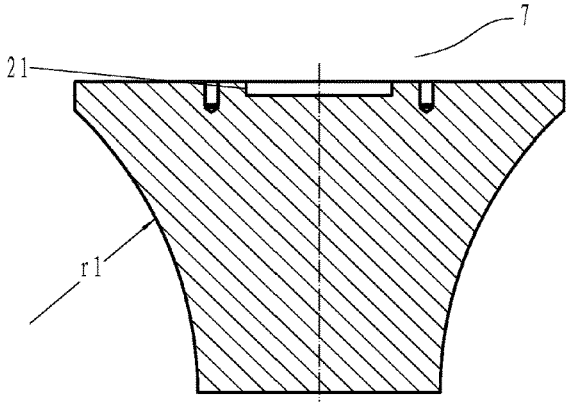
FIG. 13 is a sketch view of a profiling polishing disc base in FIG. 12.
Figure 14:
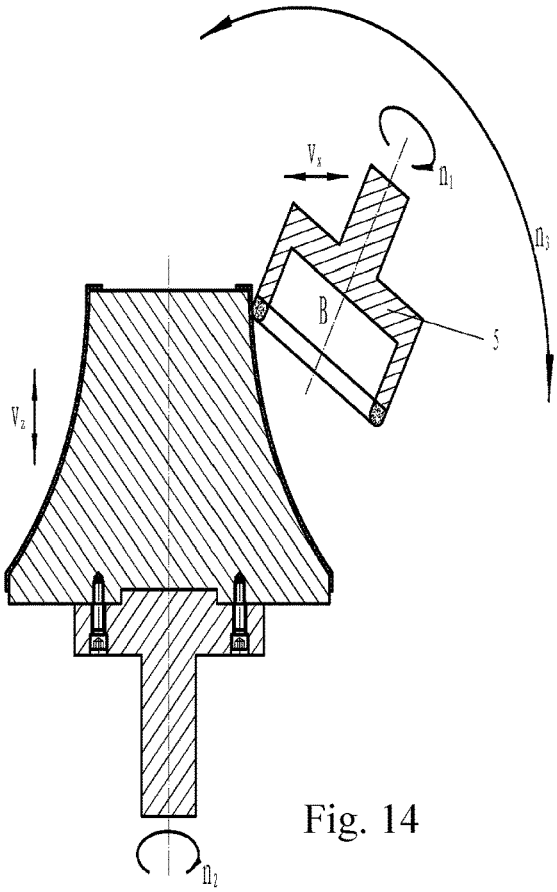
FIG. 14 illustrates trimming a polishing film according to the preferred embodiment 4 of the embodiment 2.

Referring to FIG. 12-14, a polishing disc connecting rod 11 is at a bottom of a tool shank 1, which is able to be pressed into a polishing disc fixing port 21 at a top of a profiling polishing disc base 7. During installing, the polishing disc connecting rod 11 is pressed into the polishing disc fixing port 21, and is fixed with the profiling polishing disc base 7, in such a manner that there is no interval between the polishing disc connecting rod 11 and the polishing disc fixing port 21; wherein the tool shank 1 is fixed on the profiling polishing disc base 7 by any spanner type, such as inner triangle, inner rectangle, inner hexagon, and double hole, which not only ensures connecting reliability therebetween, but also is convenient to install and maintain. The profiling polishing disc base 7 is a solid of revolution, and a generating curve thereof is an arc with a curvature radius of $r_1$. A shape of a profiling polishing disc is suitable for polishing convex elements.

A polishing film 3 is stuck on an arc portion at a bottom of the profiling polishing disc base 7. The polishing film 3 is selected according to a material of the unprocessed work piece 6. There is no requirement for a shape of the polishing film 3 as long as sticking is convenient and fixed. The polishing film 3 is stuck on a revolution surface of the profiling polishing disc base 7 by a binding agent, and a sticking height ensures that the polishing film 3 is fixedly stuck and covers the whole revolution surface.

During installing, the polishing disc connecting rod 11 is pressed into the polishing disc fixing port 21. Preferably, screws 4, which are inner hexagon bolts, are used for fixing, in such a manner that no interval exists therebetween. One side of the polishing film 3 is applied with the binding agent for being stuck on the revolution surface of the profiling polishing disc base 7. Preparation is finished after the binding agent is solidified.

After installing as above, the polishing film 3 of the polishing device 100 is trimmed. FIG. 14 illustrates trimming the polishing film 3 according to the preferred embodiment 4. The polishing device 100 is installed on a work piece shaft (not shown) of a numerical-controlled device, wherein the polishing device 100 rotates around an axis of the tool shaft and swings around a swinging center B of the tool shaft; the polishing device 100 is also movable along a horizontal direction. A trimming grinding wheel 5 is installed on a tool shaft (not shown) of the numerical-controlled device, wherein the unprocessed work piece 6 rotates around an axis of the work piece shaft and is movable along a vertical direction. A curvature radius of the polishing film 3 is trimmed by point-contacting, in such a manner that the curvature radius of the polishing film 3 is identical for improving positioning accuracy and processing accuracy.

Figure 15:
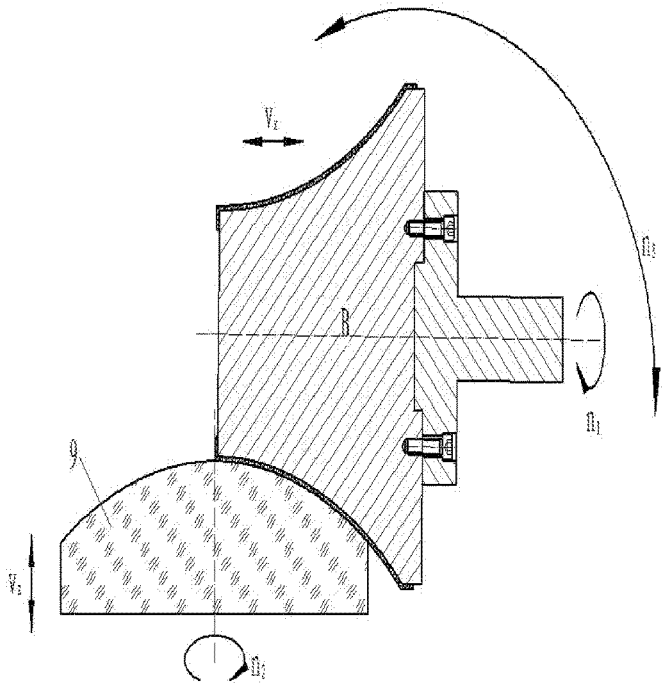
FIG. 15 illustrates polishing a convex element according to the preferred embodiment 4 of the embodiment 2.
Figure 16:
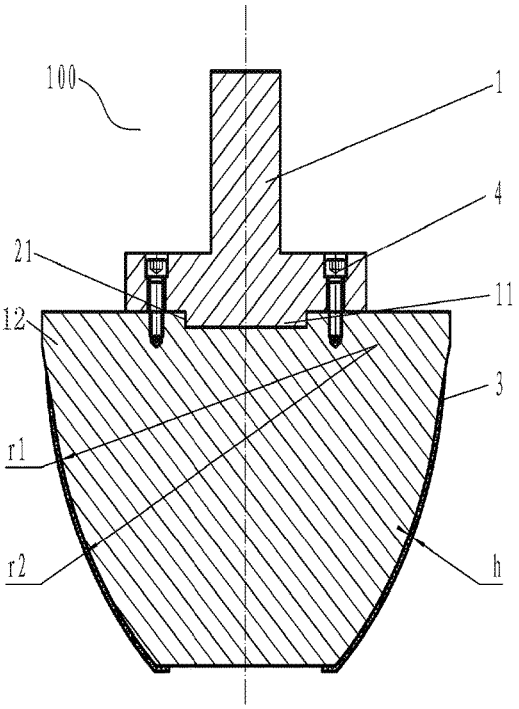
FIG. 16 is a sketch view of a polishing device according to a preferred embodiment 5 of the embodiment 2 of the present invention.

FIG. 15 illustrates polishing a convex element according to the preferred embodiment 4 with the polishing device 100. During utilization, the polishing device 100 is installed on the tool shaft (not shown) of the numerical-controlled device. The polishing device 100 rotates around an axis of the tool shaft and swings around a swinging center B of the tool shaft; and the polishing device 100 is also movable along a horizontal direction. An unprocessed work piece 6 is installed on the work piece shaft of the numerical-controlled device. The unprocessed work piece 6 rotates around an axis of the work piece shaft and is movable along a vertical direction. During polishing, surface forming parameters of an aspheric surface of the unprocessed work piece 6 and size parameters of the polishing device 100 are firstly inputted into a processing software, for generating a numerical-controlling file, so as to controlling the polishing device 100 and the unprocessed work piece 6 by the numerical-controlled device, in such a manner that the polishing device 100 line-contacts with the unprocessed work piece 6 at any processing position, and a contacting trace thereof coincides with a meridian section curve of the unprocessed spherical element.

Preferred Embodiment 5

Figure 17:
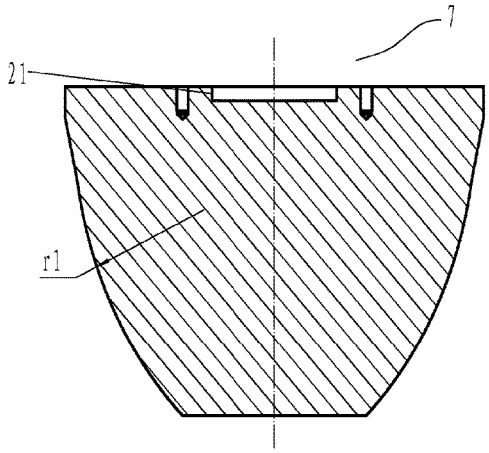
FIG. 17 is a sketch view of a bowl-like polishing disc base in FIG. 16.

FIG. 17 is a sketch view of a polishing device 100 according to the preferred embodiment 5, wherein a tool shank 1 and a profiling polishing disc base 7 are respectively illustrated in FIGS. 2 and 17. Accordingly, the polishing device 100 comprises: a tool shank 1 for installing a profiling polishing disc; a profiling polishing disc base 7 for sticking a polishing film 3; and the polishing film 3 for contacting with an unprocessed work piece 6 (not shown) for polishing. A shape of the profiling polishing disc base 7 is suitable for polishing concave elements, and installation and trimming of the polishing film 3 are the same with the preferred embodiment 4 and will not be described again.

Figure 18:
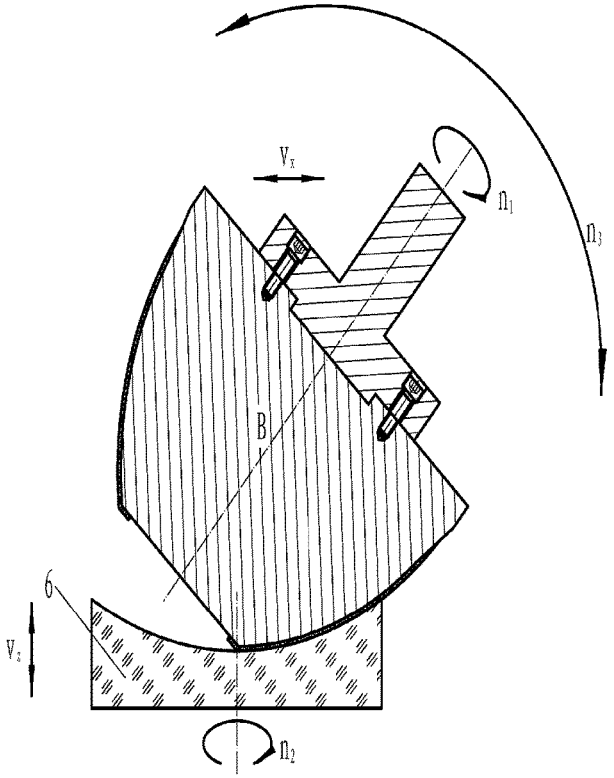
FIG. 18 illustrates polishing a concave element according to the preferred embodiment 5 of the embodiment 2.

FIG. 18 illustrates polishing the concave element according to the preferred embodiment 5, and a utilization method thereof is the same as the one of the preferred embodiment 4 and will not be described again.

Preferred Embodiment 6

Figure 19:
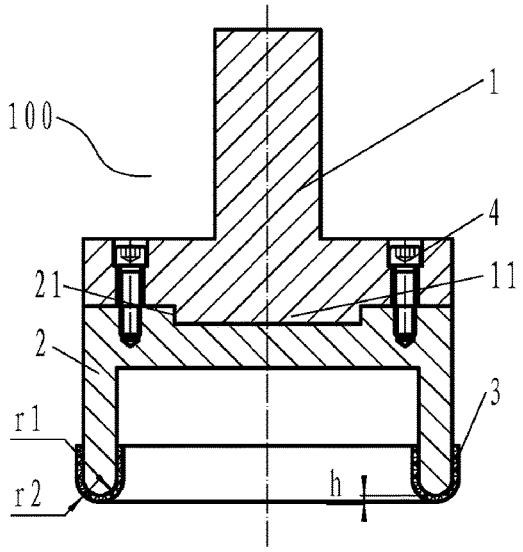
FIG. 19 is a sketch view of a polishing device according to a preferred embodiment 6 of the embodiment 2 of the present invention.
Figure 20:
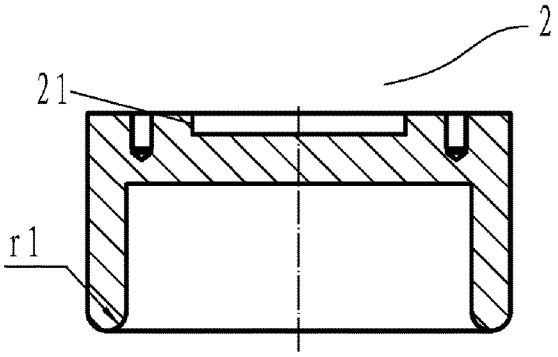
FIG. 20 is a sketch view of a cylinder polishing disc base in FIG. 19.

FIGS. 19 and 20 are sketch views of a polishing device 100 according to the preferred embodiment 6, wherein a tool shank 1 and a cylinder polishing disc base 2 are respectively illustrated in FIGS. 2 and 20. Accordingly, the polishing device 100 comprises: a tool shank 1 for installing a cylinder polishing disc; a cylinder polishing disc base 2 for sticking a polishing film 3; and the polishing film 3 for contacting with an unprocessed work piece 6 (not shown) for polishing. According to the preferred embodiment 6, installation and trimming of the polishing film 3 (shown in FIG. 24) are the same with the preferred embodiment 4 and will not be described again.

According to the preferred embodiment 6, the cylinder polishing disc base 2 is cylinder-shaped, wherein an advantage of a shape thereof is that polishing discs with same sizes is suitable for polishing work pieces with different calibers and curvature radii. A processing principle thereof is same with the one of grinding, which belongs to profiling processing. A contacting trace of the cylinder polishing disc base 2 and the unprocessed work piece 6 is an envelope circle.

Figure 21:
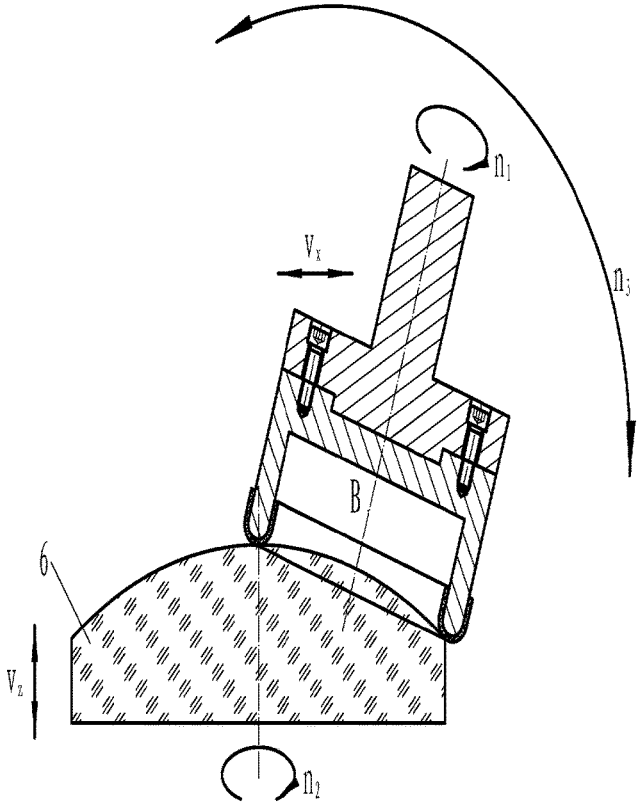
FIG. 21 illustrates polishing a convex element according to the preferred embodiment 6 of the embodiment 2.
Figure 22:
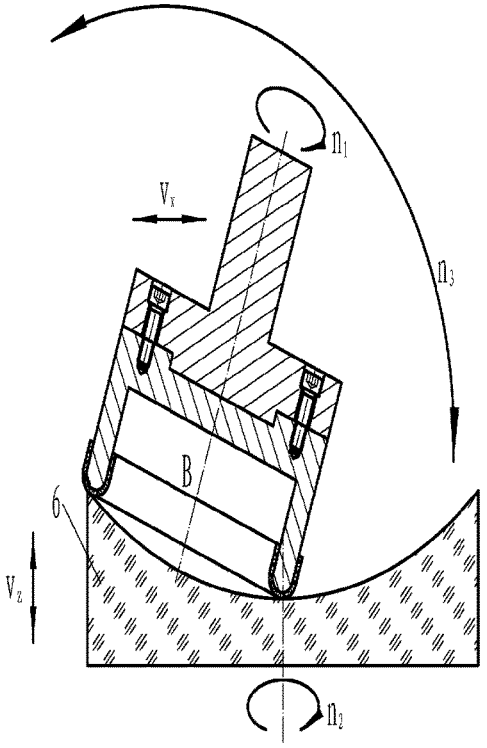
FIG. 22 illustrates polishing a concave element according to the preferred embodiment 6 of the embodiment 2.
Figure 23:
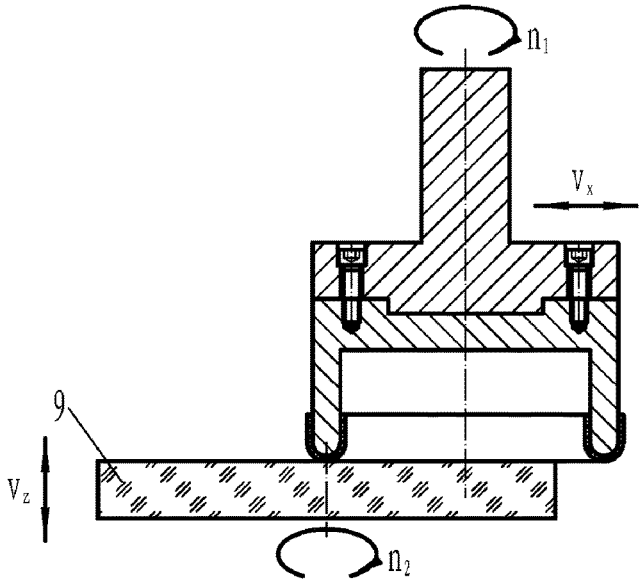
FIG. 23 illustrates polishing a planar element according to the preferred embodiment 6 of the embodiment 2.

FIGS. 21, 22 and 23 respectively illustrate polishing a convex element, a concave element and a planar element according to the preferred embodiment 6.

An Embodiment 3 of the Present Invention

Preferred Embodiment 7

Figure 24:
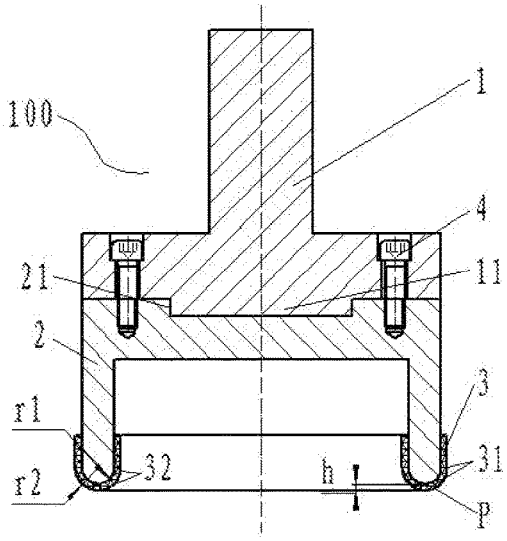
FIG. 24 is a sketch view of a polishing device according to a preferred embodiment 7 of an embodiment 3 of the present invention.
Figure 25:
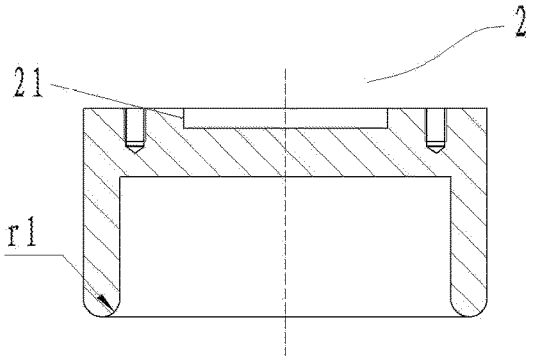
FIG. 25 is a sketch view of a cylinder polishing disc base.
Figure 26:
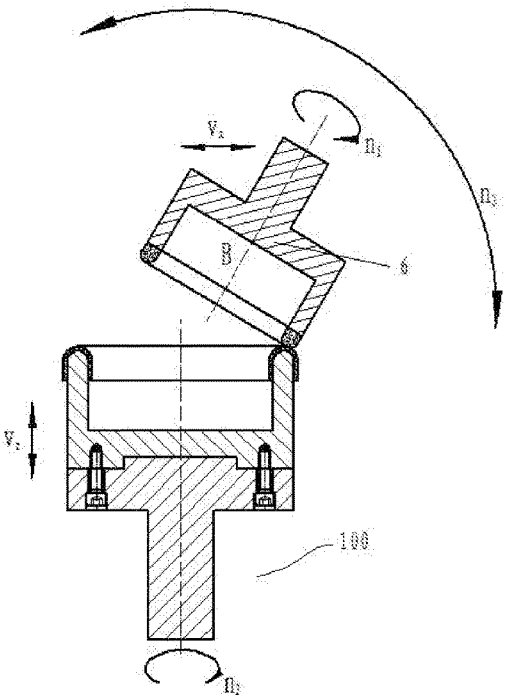
FIG. 26 illustrates trimming a polishing film of the cylinder polishing disc base.

Referring to FIGS. 2, 24 and 25, a polishing disc connecting rod 11 is at a bottom of a tool shank 1, which is able to be pressed into a polishing disc fixing port 21 at a top of a cylinder polishing disc base 2. During installing, the polishing disc connecting rod 11 is pressed into the polishing disc fixing port 21, and is fixed with the cylinder polishing disc base 2, in such a manner that there is no interval between the polishing disc connecting rod 11 and the polishing disc fixing port 21; wherein the tool shank 1 is fixed on the cylinder polishing disc base 2 by any spanner type, such as inner triangle, inner rectangle, inner hexagon, and double hole, which not only ensures connecting reliability therebetween, but also is convenient to install and maintain.

A polishing film 3 is stuck on an arc portion at a bottom of the cylinder polishing disc base 2. The polishing film 3 is selected according to a material of the unprocessed work piece 6. There is no requirement for a shape of the polishing film 3 as long as sticking is convenient and fixed. The polishing film 3 is stuck on the arc portion at the bottom of the cylinder polishing disc base 2 by a binding agent, and a sticking height ensures that the polishing film 3 is fixedly stuck.

During installing, the polishing disc connecting rod 11 is pressed into the polishing disc fixing port 21. Preferably, screws 4, which are inner hexagon bolts, are used for fixing, in such a manner that no interval exists therebetween. One side of the polishing film 3 is applied with the binding agent for being stuck on the arc-portion at the bottom of the cylinder polishing disc base 2. Preparation is finished after the binding agent is solidified.

After installing as above, the polishing film 3 of the polishing device 100 is trimmed. The polishing device 100 is installed on a work piece shaft of a numerical-controlled device, and a trimming grinding wheel 5 is installed on a tool shaft of the numerical-controlled device. A curvature radius of the polishing film 3 is trimmed by point-contacting. If the unprocessed work piece 6 is convex and is to be externally polished, trimming an external arc 31 of the polishing film 3; if the unprocessed work piece 6 is convex and is to be internally polished, trimming an internal arc 32 of the polishing film 3; if the unprocessed work piece 6 is concave, trimming the external arc 31 of the polishing film 3, or trimming the external arc 31 and the internal arc 32 of the polishing film 3. After treatment, the curvature radius of the polishing film 3 is identical, which improves positioning accuracy and processing accuracy.

Figure 27:
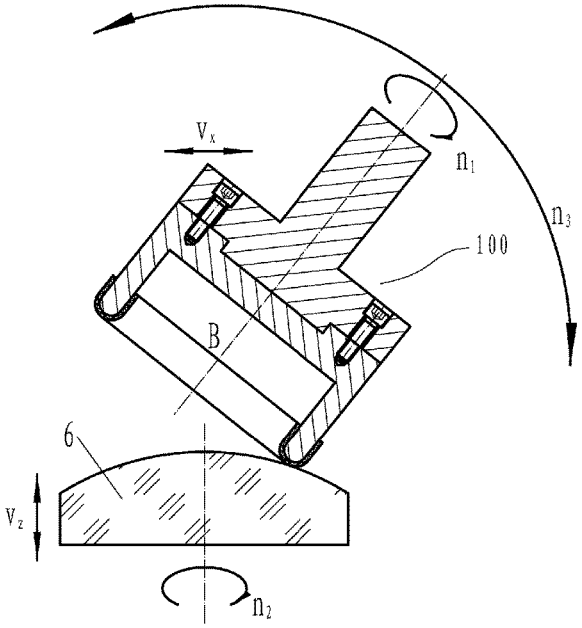
FIG. 27 illustrates externally polishing a convex aspheric optical element according to the preferred embodiment 7.

FIG. 27 illustrates externally polishing a convex aspheric optical element according to the preferred embodiment 7. During utilization, the polishing device 100 is installed on the tool shaft of the numerical-controlled device. The polishing device 100 rotates around an axis of the tool shaft and swings around a swinging center B of the tool shaft; and the polishing device 100 is also movable along a horizontal direction. An unprocessed work piece 6 is installed on the work piece shaft of the numerical-controlled device. The unprocessed work piece 6 rotates around an axis of the work piece shaft and is movable along a vertical direction. During externally polishing, a P point is at an outer area of the polishing film 3. During polishing, firstly inputting surface forming parameters of an aspheric surface of the unprocessed work piece 6 and size parameters of the polishing device 100 into a processing software, and generating a numerical-controlling file, so as to control the polishing device 100 and the unprocessed work piece 6 by the numerical-controlled device, in such a manner that the polishing device 100 contacts with the unprocessed work piece 6 at the P point of any processing position; wherein the P point coincides with an aspheric meridian section curve relative to a moving trace of the unprocessed work piece 6.

Figure 28:
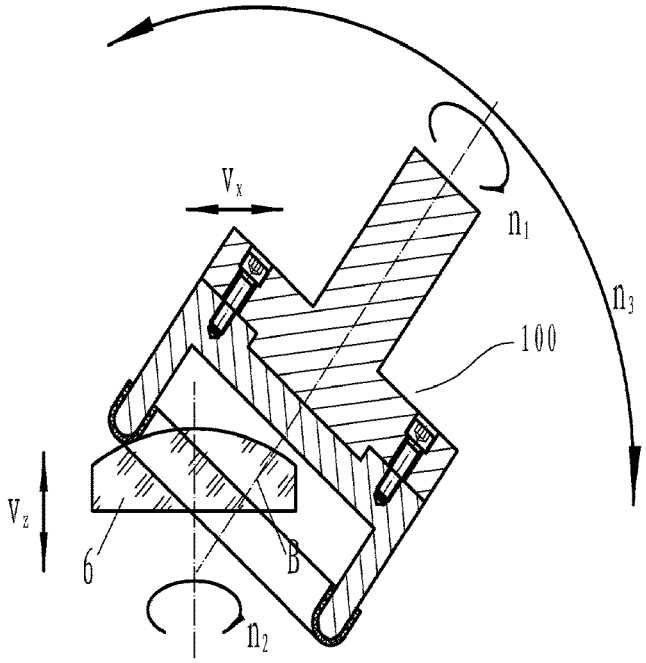
FIG. 28 illustrates internally polishing the convex aspheric optical element according to the preferred embodiment 7.

FIG. 28 illustrates internally polishing the convex aspheric optical element according to the preferred embodiment 7. The P point is at an inner area of the polishing film 3, which is different from externally polishing.

Figure 29:
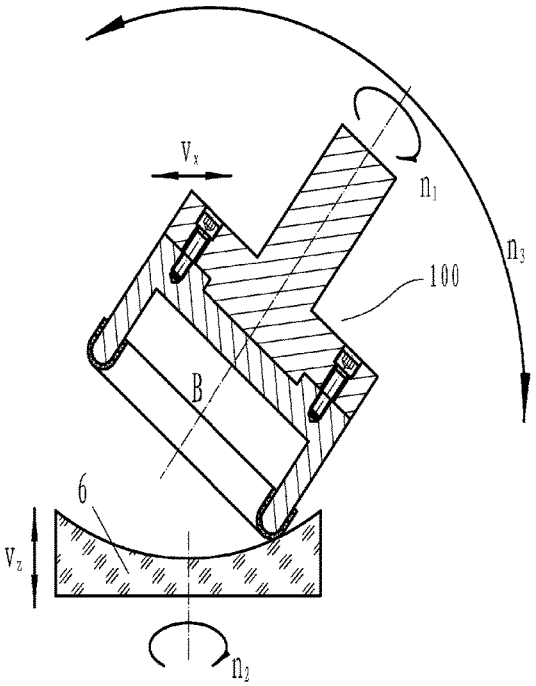
FIG. 29 illustrates polishing a concave aspheric optical element according to the preferred embodiment 7.

FIG. 29 illustrates polishing a concave aspheric optical element according to the preferred embodiment 7.

Figure 30:
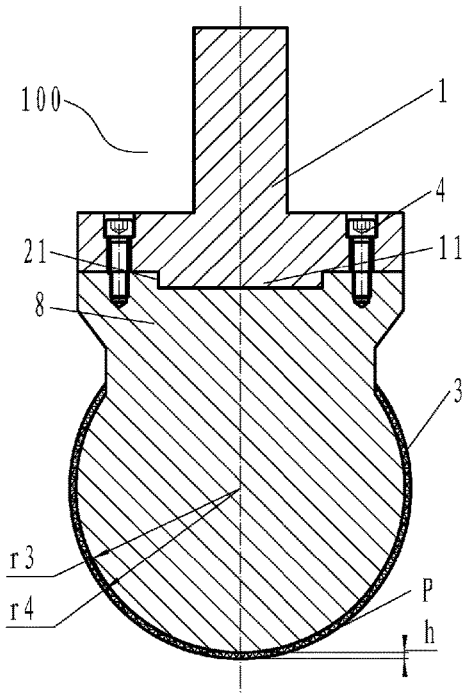
FIG. 30 is a sketch view of a polishing device according to a preferred embodiment 8 of the embodiment 3 of the present invention.
Figure 31:
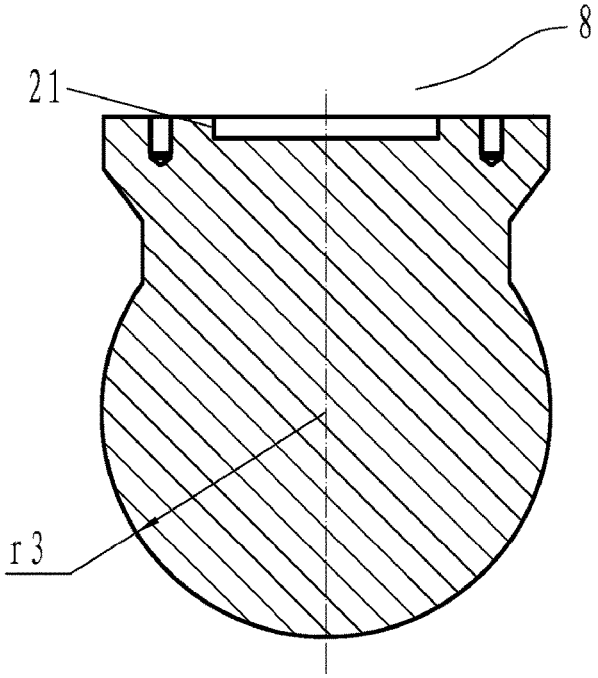
FIG. 31 is a sketch view of a spherical polishing disc base in FIG. 30.

Preferred embodiment 8: Referring to FIGS. 2 and 30, a polishing device 100 according to the preferred embodiment 8 comprises a tool shank 1 and a spherical polishing disc base 8. The polishing device 1 is same with the one in preferred embodiment 1, and the spherical polishing disc base 8 is illustrated in FIG. 31. The tool shank 1 is for installing the spherical polishing disc base 8; the spherical polishing disc base 8 is for sticking a polishing film 3; and the polishing film 3 is for contacting with an unprocessed work piece 6 (not shown) at a P point for polishing. According to the preferred embodiment 8, installation and trimming of the polishing film 3 are the same with the preferred embodiment 1.

According to the preferred embodiment 8, the spherical polishing disc base 8 is spherical, whose advantage is that a position range of the P point is larger than the one of the preferred embodiment 7, in such a manner that a linear speed range of the P point is also larger for improving polishing. According to the preferred embodiment 8, a convex element is only able to be externally polished, which is different from the preferred embodiment 7.

Figure 32:
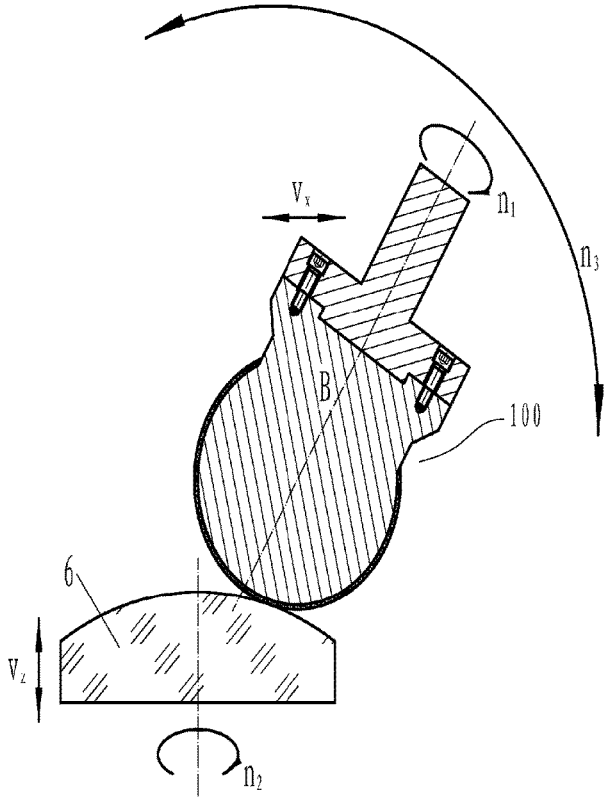
FIG. 32 illustrates polishing a convex aspheric optical element according to the preferred embodiment 8 of the embodiment 3.
Figure 33:
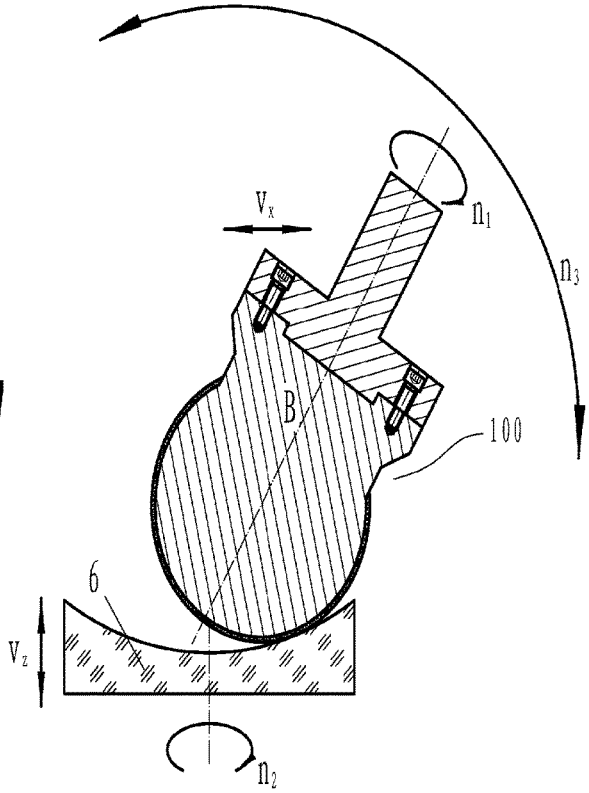
FIG. 33 illustrates polishing a concave aspheric optical element according to the preferred embodiment 8 of the embodiment 3.

FIGS. 32 and 33 respectively illustrate polishing a convex and a concave aspheric optical element according to the preferred embodiment 8.

It should be understand that, no matter in the preferred embodiment 7 or 8, a contacting area between the polishing film 3 and the unprocessed work piece 6 is point-contact. Therefore, the P point and nearby areas will be continuously worn out, which will lower processing accuracy. At that moment, a position of the P point on the polishing film 3 may be changed or the polishing film 3 may be trimmed again for regaining the processing accuracy. Preferably, the position of the P point is changed, because by trimming, an arc shape of the polishing film 3 is a standard circle, which means that a distant between the P point and an arc center is certain at any position on the arc. By changing the position of the P point, the polishing film 3 will not be trimmed again and again, which improves a coefficient of utilization thereof. After several changing, the polishing film 3 must be trimmed again for ensuring the process accuracy.

One skilled in the art will understand that the embodiment of the present invention as shown in the drawings and described above is exemplary only and not intended to be limiting. It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A partially surface-contacted polishing method for spherical or planar optical elements, comprising steps of:

1) forming a polishing device (100) by pressing a polishing disc connecting rod (11) into a polishing disc fixing port (21) hollowed at a top of a cylinder polishing disc base (2), and fixing with screws (4), in such a manner that no interval exists;

2) sticking a polishing film (3) on an arc-portion at a bottom of the cylinder polishing disc base (2) with a binding agent, and trimming a curvature radius of the polishing film (3) after the binding agent is solidified;

3) during trimming, installing the polishing device (100) on a work piece shaft of a numerical-controlled device, and installing a trimming grinding wheel (5) on a tool shaft of the numerical-controlled device; trimming the polishing film (3) by point-contacting between the trimming grinding wheel (5) and the polishing film (3), in such a manner that the curvature radius of the polishing film (3) is identical to curvature radius of the spherical or the planar optical element in value; and 4) installing the polishing device (100) on the tool shaft of the numerical-controlled device, and installing an unprocessed optical element (6) on the work piece shaft of the numerical-controlled device during polishing, firstly inputting surface forming parameters of the unprocessed optical element (6) and size parameters of the polishing device (100) into a processing software, and generating a numerical-controlling file, so as to precisely position the polishing device (100) and the unprocessed optical element (6) by the numerical-controlled device, in such a manner that a curvature center of the polishing film (3) coincides with a curvature center of the unprocessed optical element (6) at any processing position; a surface of the polishing device (100) forms ring-surface-contact with a surface of the unprocessed optical element (6) for polishing.

2. The partially surface-contacted polishing method, as recited in claim 1, wherein during utilization, the polishing device (100) is installed on the tool shaft of the numerical-controlled device; the polishing device (100) rotates around an axis of the tool shaft and swings around a swinging center B of the tool shaft; the polishing device (100) is also movable along a horizontal direction; the unprocessed optical element (6) is installed on the work piece shaft of the numerical-controlled device; the unprocessed optical element (6) rotates around an axis of the work piece shaft and is movable along a vertical direction; a moving speed of the cylinder polishing disc base (2) and a rotation speed of the unprocessed optical element (6) are controlled by the numerical-controlled device at each processing position:

wherein a curvature radius of the bottom, which is arc-shaped, of the cylinder polishing disc base (2) is $r_1$; before utilization, the polishing film (3) stuck on the arc portion of the cylinder polishing disc base (2) is trimmed, in such a manner that a surface section curve thereof is a precise arc with a curvature radius of $r_2$; a height of the polishing film (3) is h, which satisfies $r_2=r_1+h$.

3. A line-contacted polishing method for spherical or planar optical elements, comprising steps of:

1) forming a polishing device (100) by pressing a polishing disc connecting rod (11) into a polishing disc fixing port (21) hollowed at a top of a profiling polishing disc base (7), and fixing with screws (4), in such a manner that no interval exists therebetween;

2) sticking a polishing film (3) on a bottom of the profiling polishing disc base (7) with a binding agent, and trimming a curvature radius of the polishing film (3) after the binding agent is solidified; wherein the polishing film (3) is stuck on a revolution surface of the profiling polishing disc base (7), and a sticking height ensures that the polishing film (3) is fixedly stuck and covers the whole revolution surface;

3) during trimming, installing the polishing device (100) on a work piece shaft of a numerical-controlled device, and installing a trimming grinding wheel (5) on a tool shaft of the numerical-controlled device; trimming the polishing film (3) by point-contacting between the trimming grinding wheel (5) and the polishing film (3); and 4) installing the polishing device (100) on the tool shaft of the numerical-controlled device, and installing an unprocessed optical element (6) on the work piece shaft of the numerical-controlled device; during polishing, firstly inputting surface forming parameters of an aspheric surface of the unprocessed optical element (6) and size parameters of the polishing device (100) into a processing software, and generating a numerical-controlling file, so as to control the polishing device (100) and the unprocessed optical element (6) by the numerical-controlled device, in such a manner that the polishing device (100) line-contacts with the unprocessed optical element (6) at any processing position.

4. The line-contacted polishing method, as recited in claim 3, wherein during utilization, the polishing device (100) is installed on the tool shaft of the numerical-controlled device; the polishing device (100) rotates around an axis of the tool shaft and swings around a swinging center B of the tool shaft; the polishing device (100) is also movable along a horizontal direction; the unprocessed optical element (6) is installed on the work piece shaft of the numerical-controlled device; the unprocessed optical element (6) rotates around an axis of the work piece shaft and is movable along a vertical direction; a moving speed of the profiling polishing disc base (7) and a rotation speed of the unprocessed optical element (6) are controlled by the numerical-controlled device at each processing position.

5. The line-contacted polishing method, as recited in claim 3, wherein the profiling polishing disc base (7) is a solid of revolution, a generating curve thereof is an arc with a curvature radius of $r_1$; a generating curve of the polishing film (3) after being precisely trimmed is an arc with an curvature radius of $r_2$; and a height of the polishing film (3) is h, which satisfies $r_2=r_1+h$.

6. A point-contacted polishing method for aspheric optical elements, comprising steps of:

1) forming a polishing device (100) by pressing a polishing disc connecting rod (11) into a polishing disc fixing port (21) hollowed at a top of a spherical polishing disc base (8), and fixing with screws (4), in such a manner that no interval exists;

2) sticking a polishing film (3) on an arc-portion at a bottom of the spherical polishing disc base (8) with binding agent, and trimming a curvature radius of the polishing film (3) after the binding agent is solidified;

3) during trimming, installing the polishing device (100) on a work piece shaft of a numerical-controlled device, and installing a trimming grinding wheel (5) on a tool shaft of the numerical-controlled device; trimming the polishing film (3) by point-contacting between the trimming grinding wheel (5) and the polishing film (3); and 4) during utilization, installing the polishing device (100) on the tool shaft of the numerical-controlled device, and installing an unprocessed optical element (6) on the work piece shaft of the numerical-controlled device; during polishing, firstly inputting surface forming parameters of an aspheric surface of the unprocessed optical element (6) and size parameters of the polishing device (100) into a processing software, and generating a numerical-controlling file, so as to control the polishing device (100) and the unprocessed optical element (6) by the numerical-controlled device, in such a manner that the polishing device (100) contacts with the unprocessed optical element (6) at a P point of any processing position; wherein the P point coincides with an aspheric meridian section curve relative to a moving trace of the unprocessed optical element (6).

7. The point-contacted polishing method, as recited in claim 6, wherein if the unprocessed optical element (6) is convex and is to be externally polished, trimming an external arc (31) of the polishing film (3); if the unprocessed optical element (6) is convex and is to be internally polished, trimming an internal arc (32) of the polishing film (3); if the unprocessed optical element (6) is concave, trimming the external arc (31) of the polishing film (3), or trimming the external arc (31) and the internal arc (32) of the polishing film (3).

8. The point-contacted polishing method, as recited in claim 6, wherein during utilization, the polishing device (100) is installed on the tool shaft of the numerical-controlled device; the polishing device (100) rotates around an axis of the tool shaft and swings around a swinging center B of the tool shaft; the polishing device (100) is also movable along a horizontal direction; the unprocessed optical element (6) is installed on the work piece shaft of the numerical-controlled device; the unprocessed optical element (6) rotates around an axis of the work piece shaft and is movable along a vertical direction; a moving speed of the spherical polishing disc base (8) and a rotation speed of the unprocessed optical element (6) are controlled by the numerical-controlled device at each processing position.

9. The point-contacted polishing method, as recited in claim 6, wherein a curvature radius of the spherical polishing disc base (8) is $r_3$; a curvature radius of the polishing film (3) after being trimmed is $r_4$; and a height of the polishing film (3) is h, which satisfies $r_4=r_3+h$.

* * * * *